United States Patent [19]

Pfaff

[11] Patent Number: 4,656,355

[45] Date of Patent: Apr. 7, 1987

[54] CORONA TREATMENT APPARATUS

[76] Inventor: Ernest H. Pfaff, 1549 Woodvale Ave., Deerfield, Ill. 60015

[21] Appl. No.: 747,911

[22] Filed: Jun. 24, 1985

[51] Int. Cl.[4] ..... H01T 19/00

[52] U.S. Cl. ..... 250/325; 250/324; 361/229

[58] Field of Search ..... 250/324, 325, 326; 361/225, 229

[56] References Cited

U.S. PATENT DOCUMENTS 3,472,756 10/1969 Punderson ..... 250/324
3,671,195 6/1972 Bersin ..... 361/229
3,746,858 7/1973 Pevleth et al. ..... 250/325
3,824,398 7/1974 Boom ..... 250/325

*Primary Examiner*—Bruce C. Anderson
*Assistant Examiner*—Paul A. Guss
*Attorney, Agent, or Firm*—Lee, Smith & Zickert

[57] ABSTRACT

An apparatus for continuous corona treatment of materials, such as wire. An electrode is helically wound about a tubular glass dielectric, and the electrode is attached to a source of high voltage, high frequency power. In order to facilitate rapid passage of the treated material through the glass tube, blocks with internal pulleys are mounted at either end of the tube.

15 Claims, 2 Drawing Figures

CORONA TREATMENT APPARATUS

BACKGROUND OF THE INVENTION

This invention relates to corona treatment of materials, and in particular to corona treatment of elongated objects, such as wire, which has at least a thermoplastic or polymer skin.

Corona modification of the surface properties of thermoplastics and other polymers is well known. Treatment of the surface properties is used in order to increase the surface tension, and hence the wettability of common polymers, such as fluoronated polyolefins, which have quite slick surfaces and therefore do not readily accommodate paint, print or other coatings.

Traditional corona surface treatment incorporates a generator and transformer for creating low frequency, high voltage power. That power is then directed to an electrode which is spaced from a second, grounded electrode. The material to be treated is placed or passed between the spaced electrodes for a predetermined amount of time, depending on the material, the spacing between the electrodes, the voltage applied and the frequency.

High frequency surface treating has been introduced by the assignee of this application. By high frequency, it is meant above 1 MHz, preferably around 2 MHz. At such high frequencies, a useful corona is produced using only a single electrode, thus eliminating the need for the second grounded electrode.

In the past, when continuous treatment of lengthy materials, such as wire, is desired, the wire is passed through a loop electrode for treatment. However, because of the small width (in the axial direction of the wire) of the loop, treatment must proceed rather slowly. The power applied can only be increased to certain limits, however, since direct electrical discharge between the electrode and the wire can occur, causing destruction of the insulated coating covering the wire. In order to alleviate this problem and increase somewhat the speed of treatment, a metal tube has been substituted for the loop electrode. However, the same discharge problems occur, thus not permitting high speed treatment of coated electrical wires.

SUMMARY OF THE INVENTION

The present invention solves the treatment speed deficiencies of the prior art by providing a unique electrode arrangement for corona treatment apparatus. The electrode arrangement comprises an elongated, tubular dielectric about which a wire electrode is helically wound. Except at its ends, the coils of the electrode are spaced and the electrode is secured to the dielectric to maintain the spacing of the coils. In accordance with the preferred embodiment of the invention, the tubular dielectric is a glass tube and the electrode is tungsten wire.

For securing the electrode to the glass tube, a pair of posts are attached at opposite ends of the tube. One of the posts may be hollow, communicating with the hollow interior of the glass tube in order to permit passage of supplementary treatment gas through the posts into the interior of the tube. Each end of the electrode includes a coil which is wrapped about itself and about its associated post. A lead extends from one end of the electrode, preferably comprising an extended end of the electrode, and is attached to a source of high voltage, high frequency power.

In order to facilitate continuous passage of wire or other material to be treated, a block is mounted at each end of the tube. A pulley is situated in each block so that the material to be treated may be passed smoothly and rapidly into and from the internal corona create within the tube by the electrode.

BRIEF DESCRIPTION OF THE DRAWING

The invention is described in greater detail in the following description of an example embodying the best mode of the invention, taken in conjunction with the drawing, in which.

DESCRIPTION OF AN EXAMPLE EMBODYING THE BEST MODE OF THE INVENTION

Figure 1:
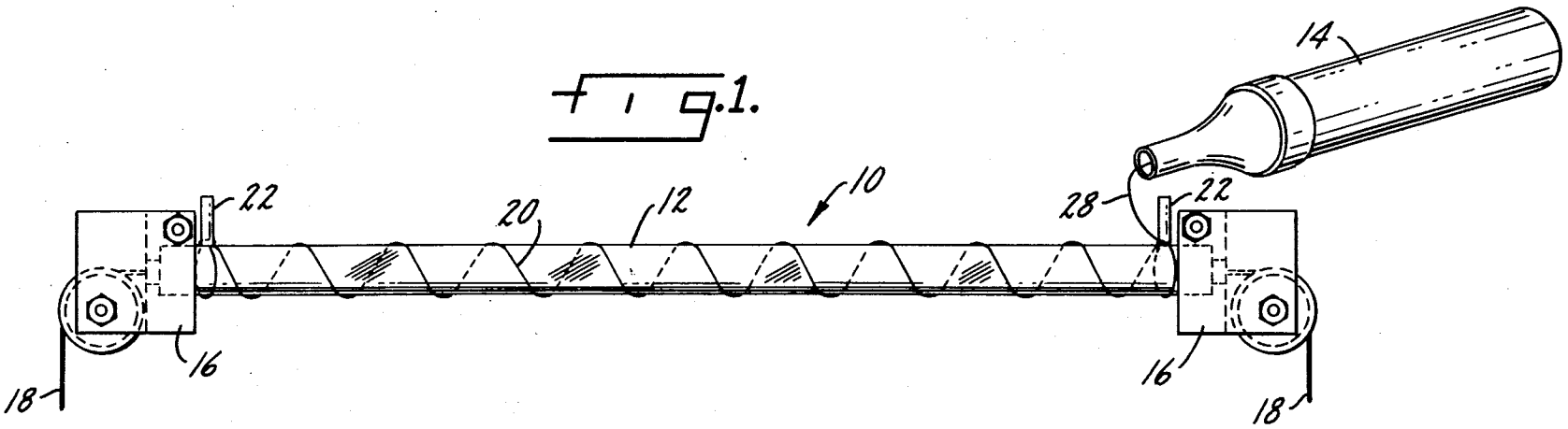
FIG. 1 is a schematic, elevational view of the apparatus according to the invention.

An apparatus according to the invention is designated generally at 10 in the drawing figures. The apparatus 10 is composed of an elongated, tubular dielectric in the form of a glass tube 12, a source of high voltage, high frequency power 14, and a pair of pulley arrangements 16 to facilitate rapid passage of a wire 18 through the tube 12. Although not shown in detail, the wire 18 is normally coated with an insulating polymer, which does not normally accept paint or other coatings.

The glass tube 12, as its name would connote, is hollow in order to permit free passage of the wire 18 therethrough. While the tube 12 is preferably clear, thus permitting visual inspection of the corona and wire within the tube, the wire 18 within the tube 12 has been omitted in FIG. 1 for purposes of clarity. An electrode 20 is helically wound about the exterior of the glass tube 12, with the coils of the electrode 20 being spaced as shown.

Figure 2:
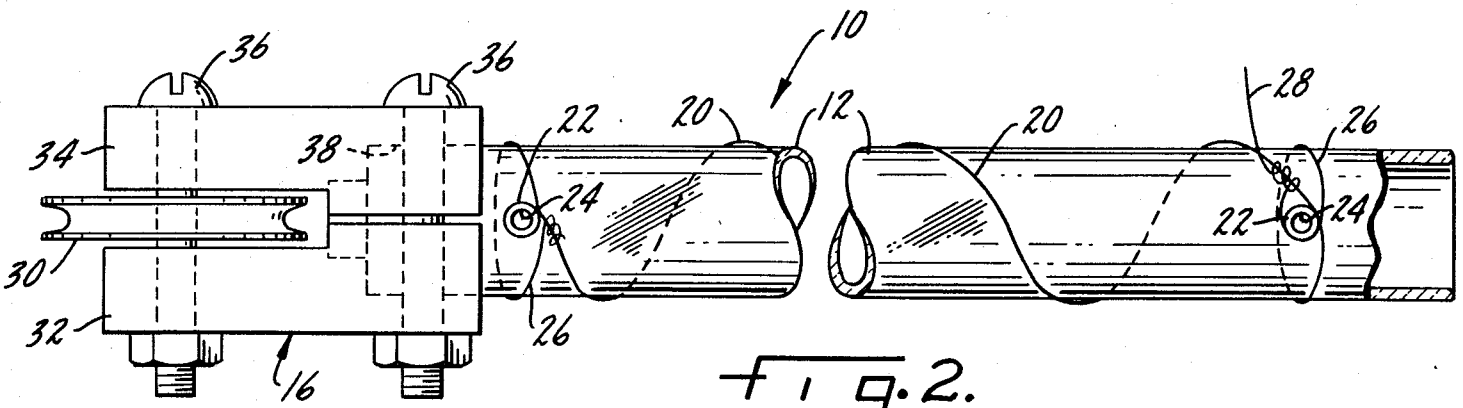
FIG. 2 is an enlarged, partial top view of the apparatus of FIG. 1 with portions removed and other portions broken away in order to illustrate detail.

The electrode 20 is secured about the tube 12 by means of a pair of posts 22 which are attached to the tube 12 at opposite ends thereof. As best shown in FIG. 2, one or both of the posts 22 may have a hollow interior 24 in order to permit introduction of a supplemental treatment gas through the post 22 into the interior of the tube 12.

At each end, the electrode 20 includes an end coil 26 which is wrapped about itself and about the associated post 22 in order to prevent arcing at the ends. Preferably, one of the ends of the electrode 20 is extended as a lead 28 and is connected to the power source 14, although a separate lead could be used so long as it is securely attached to an end coil 26 without any free end which could cause an arc.

The power source 14 may be any source of high voltage, radio frequency power, but preferably is a source similar to the BD-80 high frequency corona generator of the Electro-Technic Products Company, Chicago, Ill. This corona generator develops a high voltage at high frequency and preferably is operated at 250,000 volts and a frequency of 2 MHz. At such high frequencies, the shape of the voltage curve tends to be fairly noisy, creating a particularly good corona within the glass tube 12.

Each pulley arrangement 16 comprises a pulley 30 sandwiched within a block composed of block elements 32 and 34. The block is held together by a pair of bolts 36, one of which also properly positions the pulley 30.

When assembled, the two block elements 32 and 34 include an aperature 38 which is dimensioned to accomodate one end of the glass tube 12, as best shown in FIG. 2. The central axis of the aperature 38 is aligned tangentially with the periphery of the pulley 30 such that when the apparatus 10 is assembled, the wire 18 will pass centrally and symmetrically within the glass tube 12 to assure that the coating on the wire 18 is properly treated by the corona created within the glass tube 12.

While the tube 12 has been defined as a glass tube, and the posts 22 are preferably smaller glass tubes which are heat welded to the glass tube 12, it is evident that the tube 12 can be made of other materials, so long as they are dielectrics which permit generation of a corona within the tube 12. Glass is preferable since not only can the corona be readily observed due to the transparency of the glass, but should any discharge occur, that can also be readily observed.

Various changes can be made to the invention without departing from the spirit thereof or scope of the following claims.

What is claimed is:

1. An electrode arrangement for corona treatment of coated conductive materials, comprising a. an elongated, tubular dielectric open to and maintained internally at atmospheric pressure, b. a single electrode helically wound about the exterior of said dielectric, said electrode having spaced coils, c. means securing said electrode to said dielectric, and d. means for connecting one end of said electrode to a source of high voltage, high frequency power to produce corona irradiation of said coated conductive material.

2. An electrode arrangement according to claim 1 in which said dielectric comprises a glass tube.

3. An electrode arrangement according to claim 1 in which said securing means comprises a pair of posts attached to said dielectric at opposite ends thereof.

4. An electrode arrangement according to claim 3 in which at least one of said posts includes a hollow interior and said hollow interior communicates with the interior of said dielectric to permit passage of gas through said one post into the interior of said dielectric.

5. An electrode arrangement accroding to claim 3 in which said electrode includes an end coil which is wrapped about itself at each said post.

6. An electrode arrangement according to claim 1 in which said connecting means comprises a lead extending from one end of said electrode.

7. An apparatus for corona treatment of coated conductive materials, comprising a. an elongated, tubular dielectric open to and maintained internally at atmospheric pressure, b. a single electrode helically wound about the exterior of said dielectric, and electrode having spaced coils, c. means securing said electrode to said dielectric, d. a source of high voltage, high frequency power, e. means for connecting one end of said electrode to said source of high voltage, high frequency power, and f. means to facilitate continuous passage of said coated conductive material to be treated through said dielectric to produce corona irradiation of said coated conductive material.

8. An apparatus according to claim 7 in which said dielectric comprises a glass tube.

9. An apparatus according to claim 7 in which said securing means comprises a pair of posts attached to said dielectric at opposite ends thereof.

10. An apparatus according to claim 9 in which at least one of said posts includes a hollow interior and said hollow interior communicates with the interior of said dielectric to permit passage of gas through said one post into the interior of said dielectric.

11. An apparatus according to claim 9 in which said electrode includes an end coil which is wrapped about itself at each said post.

12. An apparatus according to claim 7 in which said connecting means comprises a lead extending from one end of said electrode.

13. An apparatus according to claim 7 in which said means to facilitate comprises a pulley at each end of said dielectric, and means locating said pulley at said end of said dielectric.

14. An apparatus according to claim 13 is which said locating means comprises a block mounting said pulley and attached to said end.

15. An apparatus according to claim 14 in which said block includes an aperture whose central axis is aligned tangentially with said pulley, said aperture being dimensioned to accommodate insertion of said end.

* * * * *